US007592296B2

(12) United States Patent
Sperling

(10) Patent No.: US 7,592,296 B2
(45) Date of Patent: Sep. 22, 2009

(54) CONVEYOR TRACK OR CONTAINER LUBRICANT COMPOSITIONS

(75) Inventor: Barry D. Sperling, Hebron, KY (US)

(73) Assignee: JohnsonDiversey, Inc., Sturtevant, WI (US)

( * ) Notice: Subject to any disclaimer, the term of this patent is extended or adjusted under 35 U.S.C. 154(b) by 526 days.

(21) Appl. No.: 11/195,164

(22) Filed: Aug. 2, 2005

(65) Prior Publication Data

US 2006/0030497 A1 Feb. 9, 2006

(51) Int. Cl.
*C10M 169/04* (2006.01)

(52) U.S. Cl. ..... 508/208

(58) Field of Classification Search ..... 508/208
See application file for complete search history.

(56) References Cited

U.S. PATENT DOCUMENTS

| | | | | |
|---|---|---|---|---|
| 4,514,319 | A | 4/1985 | Kulkarni et al. | 252/321 |
| 5,047,159 | A | 9/1991 | Zehler | 252/49.6 |
| 5,591,759 | A * | 1/1997 | Ito et al. | 514/372 |
| 5,712,229 | A * | 1/1998 | Hopkins et al. | 508/202 |
| 5,780,545 | A | 7/1998 | Chen et al. | 524/860 |
| 5,968,872 | A | 10/1999 | Policello et al. | 504/116 |
| 6,221,811 | B1 | 4/2001 | Policello et al. | 504/351 |
| 6,221,922 | B1 | 4/2001 | Policello et al. | 516/118 |
| 6,420,323 | B2 * | 7/2002 | Geke et al. | 508/532 |
| 6,506,261 | B1 * | 1/2003 | Man | 134/39 |
| 6,667,283 | B2 * | 12/2003 | Kravitz et al. | 508/438 |
| 6,841,257 | B2 | 1/2005 | Sasaki et al. | 428/447 |
| 6,908,962 | B1 | 6/2005 | Frankenbach et al. | 524/588 |
| 2001/0003733 | A1 | 6/2001 | Kupper et al. | 508/181 |

FOREIGN PATENT DOCUMENTS

| | | |
|---|---|---|
| EP | 0 046 342 B1 | 2/1985 |
| EP | 1 096 060 A1 | 5/2001 |

OTHER PUBLICATIONS

ECN: Dynamics of surfactant enhance spreading, Randal M. Hill, 9 pgs, http://www.coatings.de/articles/hill/hill.htm dated Jun. 1, 2004.

Alam Sundaram—"*Influence of Two Polymeric Adjuvants on Physical Properties, Droplet Spreading and Drying Rates, and Foliar Uptake and Translocation of Glyphosate in Vision® Formulation*" (pp. 93-107) ; 1990.

* cited by examiner

*Primary Examiner*—Glenn A Caldarola
*Assistant Examiner*—Taiwo Oladapo
(74) *Attorney, Agent, or Firm*—Gregory S. Bollis

(57) ABSTRACT

Conveyor track lubricant composition and methods comprising use of siloxane oil and a spreading agent, such as a trisiloxane spreading agent. The lubricant compositions may also contain biocide materials and stress crack resistance materials.

19 Claims, No Drawings

CONVEYOR TRACK OR CONTAINER LUBRICANT COMPOSITIONS

FIELD OF THE INVENTION

The present invention relates to conveyor track or container lubricant compositions, and their use with conveyors in bottling facilities, particular food and beverage bottling facilities, and most preferably in bottling facilities using plastic bottles, such as bottles made from polyethylene terephthalate (PET) polymers widely used in the carbonated beverage industry.

BACKGROUND OF THE INVENTION

In the commercial distribution of many products, including most beverages, the products are packaged in containers of varying sizes. The containers can be made of paper, metal or plastic, in the form of cartons, cans, bottles, Tetra Pak™, packages, waxed carton packs, and other forms of containers. In most packaging operations, the containers are moved along conveying systems, usually in an upright position, with the opening of the container facing vertically up or down. The containers are moved from station to station, where various operations, such as filling, capping, labeling, sealing, and the like, are performed. Containers, in addition to their many possible formats and constructions, may comprise many different types of materials, such as metals, glasses, ceramics, papers, treated papers, waxed papers, composites, layered structures, and polymeric materials.

During filling and transport of the containers the conveyors may vary speed, turn corners or be inclined up or down. When the bottles are held stationary, such as at a filling station, the conveyor must move along under the bottles with minimum resistance. If the friction between the bottles and the conveyors or between the bottles is too great, the bottles may stick together and block the conveyor line or tip over. Thus, it is required to lubricate the conveyor and even the containers so that the containers can glide past one another or allow the conveyor surface to glide underneath the bottles without blocking or tipping. On the other hand, the friction cannot be so little that the bottles cannot couple with and move with the conveyor when intended, such as up or down inclines, when completing a sorting operation or when released from a filling station, or the like. If the containers tip or otherwise do not operate properly upon the conveyor, the conveyor may be halted to remedy the problem or may become inefficient in moving the containers or the containers may leave the conveyor surface and fall on the floor of the facility.

In addition, where food products are being processed, the conveyor is subject to the buildup of deposits from food products being spilled from the containers and onto the containers themselves, the conveyor surfaces, the other structural elements of the conveyor and other parts of the facility.

Accordingly, conveyor track and container lubricant compositions are needed which will impart the proper surface characteristics to the containers and the surface of the conveyor to provide the necessary frictional relationship. Lubricating solutions are often used on conveying systems during the filling of containers with, for example, beverages. There are a number of different requirements that are desirable for such lubricants. For example, the lubricant should provide an acceptable level of lubricity for the system. It is also desirable that the lubricant have a viscosity which allows it to be applied by conventional pumping and/or application apparatus, such as by spraying, roll coating, wet bed coating, and the like, commonly used in the industry. It is desirable for the lubricant to possess biocidal and cleaning properties where needed to prevent microorganism growth in the lubricant and on the conveyor system and maintain cleanliness.

SUMMARY OF THE INVENTION

An aspect of the present invention provides a silicone lubricant conveyor track or container composition comprising a silicone lubricating oil and a spreading agent, the composition having a spreading ratio of at least 4, and preferably at least 7, on polybutene compared to water agents. Spreading agents useful for providing the desired spreading ratio and other desired characteristics for the lubricating compositions are certain trisiloxane alkoxylate compounds.

In another aspect, the present invention provides a method of lubricating a conveyor track or container comprising applying a silicone lubricant conveyor track or container composition described above to the conveyor track or container. More specifically, there is provided a method for lubricating the passage of a container along a conveyor comprising applying a mixture of a siloxane composition in combination with one or more agents for improving the wetting of said siloxane composition on a conveyor or container surface to at least a portion of the container-contacting surface of the conveyor or at least a portion of the conveyor contacting surface of the container.

Another aspect of the present invention is to provide a lubricated conveyor or container, having a lubricant coating on a container-contacting surface of the conveyor or on a conveyor-contacting surface of the container wherein the lubricant coating is formed using the lubricating composition described above.

In yet another aspect, the lubricating compositions of the present invention can provide biocidal capability.

DETAILED DESCRIPTION OF THE INVENTION

Compositions of the present invention can spread to areas where conventional lubricants cannot reach because of the inclination of the surface or spray streams used to apply the liquid. For example, if a conventional lubricant is applied to an inclined surface it may simply bead up and fall off due to gravity. Alternatively, when spray applicators are used, the force of the spray stream can push beaded lubricant off the track surface. In contrast, the lubricant compositions of the present invention tend to spread uniformly over such surface in spite of the effect of gravity. In other words, the compositions provide a more uniform thin film, and resist beading on the surface to which they are applied. By resisting beading, the lubricating film will stay in place. Another advantage is that the lubricants of the present invention can penetrate small openings, such as cracks and close tolerance parts to provide more thorough lubrication. The improved spreadability in turn provides more complete antimicrobial control because the lubricant covers all surfaces. Another advantage is that the lubricant is more cost effective due to the ability of the lubricant to spread more effectively. Less of the silicone film forming material can be used to achieve the same effect.

The present invention involves the use of silicone, or siloxane, lubricant oil in combination with a spreading agent. The silicone oil can be used alone or in combination with a liquid vehicle, such as in the form of a dispersion or emulsion. The spreading agent improves the ability of the silicone material to impart thin, continuous lubricant films to conveyor tracks or to containers conveyed on such tracks, or both.

The silicone lubricating oils which can be used to provide the primary film-forming properties in the lubricant compositions of the present invention readily available commercially from numerous manufacturers and are used in known conveyor track lubricant compositions. Silicone lubricating oils useful in the present invention are those water-miscible or water dispersible silicone oils that can be used to form reasonably stable emulsions with or without the use of additional surfactants or emulsifiers, such as the polydimethylsiloxane compounds. Preferably these are emulsions formed from methyl, dimethyl, and higher alkyl and aryl silicones, functionalized silicones such as hydroxy-, chloro-, methoxy-, epoxy- and vinyl substituted siloxanes. Typically these are provided in the form of emulsions of siloxane materials dispersed or emulsified in water. The viscosity of the silicone oils useful in the present invention will typically be less than about 10,000 Centistokes.

Suitable silicone emulsions include E2175 high viscosity polydimethylsiloxane (a 60% siloxane emulsion commercially available from Lambent Technologies, Inc.), E21456 FG food grade intermediate viscosity polydimethylsiloxane (a 35% siloxane emulsion commercially available from Lambent Technologies, Inc.), HV490 high molecular weight hydroxy-terminated dimethyl silicone (an anionic 30-60% siloxane emulsion commercially available from Dow Corning Corporation), the LE-Series of dimethyl and organomodified silicone emulsions having viscosities ranging from about 300 to more than 10,000 cSt available from GE Silicones, such as LE-46 which is a 35% polydimethyl siloxane aqueous emulsion, SM2135 polydimethylsiloxane (a nonionic 50% siloxane emulsion commercially available from GE Silicones), and SM2167 polydimethylsiloxane (a cationic 50% siloxane emulsion commercially available from GE Silicones. Other water-miscible silicone materials include finely divided silicone powders such as the TOSPEARL™ series (commercially available from Toshiba Silicone Co. Ltd.); and silicone surfactants such as SWP30 anionic silicone surfactant, WAXWS-P nonionic silicone surfactant, QUATQ-400M cationic silicone surfactant and 703 specialty silicone surfactant (all commercially available from Lambent Technologies, Inc.). Preferred silicone emulsions typically contain from about 30 wt. % to about 70 wt. % water. Non-water-miscible silicone materials (e.g., non-water-soluble silicone fluids and non-water-dispersible silicone powders) can also be employed in the lubricant if combined with a suitable emulsifier (e.g., nonionic, anionic or cationic emulsifiers). For applications involving plastic containers (e.g., PET beverage bottles), care should be taken to avoid the use of emulsifiers or other surfactants that promote environmental stress cracking in plastic containers when evaluated using the PET Stress Crack Tests used in the bottling industry. Polydimethylsiloxane emulsions are preferred silicone materials. Preferably the lubricant composition is substantially free of surfactants aside from those that may be required to emulsify the silicone compound sufficiently to form the silicone emulsion.

Included in the compositions of the invention are one or more spreading agents which enhance the ability of the silicone oil to form persistent, thin films on conveyor tracks and containers, particularly those polymeric in nature. Preferred spreading agents have surface tensions of less than 30 dynes/cm and more preferably about 20 to 23 dynes/cm, and provide lubricating compositions with spreading ratios as measured on polybutene compared to water of at least about 4 and preferably at least about 7.

Organosiloxane spreading agents are useful in the present invention, and include the trisiloxane alkoxylates (TSA). The TSA's have a general formula I, (I)

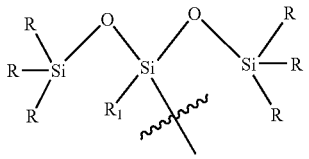

Appended to the middle silicone atom are one or more alkylene oxide organic groups. Highly preferred is an alkyleneoxide modified heptamethyl TSA, particularly a heptamethyl trisiloxane with a hydroxy end-capped alkylene oxide moiety containing up to 4 ethylene oxide groups.

Spreading agents particularly useful are the TSA's of the formula (II)

(II)

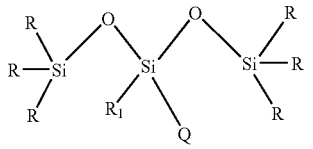

wherein Q is $C_dH_{2d}O[(C_2H_4O)_t(C_3H_6O)_w)]R_2$, d is 1-5, t is 0-25, w is 0-25, t+w=1-50; $R_2$ is hydrogen, hydroxyl, $C_1$ to $C_4$ alkyl, amine, or acetyl; each R is independently Q, hydrogen, hydroxyl, or $C_1$ to $C_4$ alkyl; and $R_1$ is $C_1$ to $C_3$ alkyl. It is to be understood the oxyalkene groups, $C_2H_4O$ and $C_3H_6O$, may be in random (mixed), or block order.

Preferred are the compounds of formula (II) where d is 2 or 3, t is 0-10, preferably 3 or 4, w is 0-10, preferably 0, t+w=1-10; $R_2$ is hydrogen or $C_1$ to $C_4$ alkyl, preferably methyl; and each R is independently hydrogen or $C_1$ to $C_4$ alkyl, preferably all methyl; and $R_1$ is methyl. A preferred group of trisiloxane materials are commercially available from GE Silicones under the trade name Silwet®. particularly Silwet® L-7608, which is a heptamethyl trisiloxane with a hydroxy terminated polyethyleneoxide pendant group (d is 3, t is 3 or 4, w is 0, $R_2$ is hydrogen, and all R's and $R_1$ are methyl groups.)

The weight fraction of the organosilicone spreading agent in the dilutable lubricant concentrate is preferred to be from 1% to 20%, preferably from about 1% to about 10% and most preferably from about 1% to about 5% based on the weight of the total dilutable lubricant concentrate. The ratio of the organosilicone spreading agent to the silicone film forming component should be from 0.05 up to 100 parts spreading agent to 1 part silicone oil, most preferably from 0.5 to 5 parts spreading agent to 1 part silicone oil and most preferably 0.5-1.2 parts spreading agent to 1 part silicone oil. If there is too little of the organosilicone material it will not provide the most effective spreading characteristics to the composition. If there is too much organosilicone the material will not be able to be dispersed in the aqueous vehicle and the solution will separate.

The trisiloxanes described above are susceptible to hydrolysis in acid and base environments. It is therefore desirable to maintain the pH of the trisiloxane compositions between about 5.5 and 8, and preferably between about 6.5 and 7.8 for long term stability and spreading effectiveness. Various acidic and basic pH adjusting agents can be used as well as various buffering agents.

In addition to the lubricant and spreading agent, other components can be included with the lubricant compositions to provide the desired properties. For example, antimicrobial agents, colorants, foam inhibitors or foam generators, PET stress cracking inhibitors, viscosity modifiers, friction modifiers, antiwear agents, oxidation inhibitors, rust inhibitors, chelating agents, extreme pressure agents, detergents, dispersants, foam inhibitors, film forming materials and/or surfactants can be used, each in amounts effective to provide the desired results.

Stress crack inhibitors, such as sodium cumene sulfonate can also be used to inhibit any stress cracking tendencies of the formula. A particularly useful lubricant can be prepared by using a combination of sodium cumene sulfonate and sodium 1,2 benzisothiazolin-3-one.

Useful biocidal or antimicrobial agents include disinfectants, antiseptics and preservatives. Non-limiting examples of useful antimicrobial agents include phenols including halo- and nitrophenols and substituted bisphenols such as 4-hexylresorcinol, 2-benzyl-4-chlorophenol and 2,4,4'-trichloro-2'-hydroxydiphenyl ether, organic and inorganic acids and its esters and salts such as dehydroacetic acid, peroxycarboxylic acids, peroxyacetic acid, methyl p-hydroxy benzoic acid, cationic agents such as quaternary ammonium compound, aldehydes such as glutaraldehyde, antimicrobial dyes such as is acridines, triphenylmethane dyes and quinones and halogens including iodine and chlorine compounds. The antimicrobial agents can be used in an amount sufficient to provide resistance to the growth of bacteria and the formation of slime in the concentrated lubricant composition, or, if and when diluted to final use concentration, without contributing to instability of the formula. For example, from 0 to about 5.0 weight percent, preferably about 0.5 to about 2.0 weight percent of antimicrobial agent and most preferably about 0.5 to about 1.0 weight percent, based on the total weight of the concentrate composition can be effective.

A particularly preferred class of biocidal components are the alkali metal salts of isothiazoline biocides, such as methyl-4-isothiazolin-3-one available from Rohm and Haas as a 40-60% solution in propylene glycol under the trade name Kordek LX5000, and benzyl substituted isothiazoline biocides such 1,2 benzisothiazolin-3-one available from Avecia as a 20% solution in propylene glycol under the trade name Proxel GXL.

Detergents and dispersants that are useful include alkylbenzenesulfonic acid, alkylphenols, carboxylic acids, alkylphosphonic acids and their calcium, sodium and magnesium salts, polybutenylsuccinic acid derivatives, silicone surfactants, fluorosurfactants, and molecules containing polar groups attached to an oil-solubilizing aliphatic hydrocarbon chain. The detergent and/or dispersants are used in an amount to give desired results. This amount can range from 0 to about 30, preferably about 0.5 to about 20 percent by weight for the individual component, based on the total weight of the composition.

Foam inhibitors that can be used in the invention include, among others, methyl silicone polymers. Non-limiting examples of useful foam generators include surfactants such as non-ionic, anionic, cationic and amphoteric compounds. These components can be used in amounts to give the desired results.

Chelating or sequestering agents can be added for the purpose of improving hard water tolerance. Useful chelating agents are the phosphonates, such as amino tris(methylenephosphonic acid) 50% by weight in water commercially available from Solutia, Inc. under the trade name Dequest 2000, ethylenediaminetetraacetic acid, Gluconates and succinates and the like.

The lubricant compositions of the present invention are typically prepared as aqueous solutions, dispersions or emulsions, or combinations thereof, by conventional mixing and dispersing techniques. Typical formulations may contain from about 0.05 to 50 parts by weight polydimethyl siloxane lubricating oil (often dispersed or emulsified in water), about 1 to 10 parts by weight spreading agent and about 50 to about 98 parts by weight water. Other ingredients such as biocides, stress crack inhibitors, stabilizers, chelants and other water conditioning chemicals may also be added. In a preferred embodiment, certain components that act as both biocides and stress crack inhibitors provide a particularly useful composition. The amount of such ingredients will vary depending on the environment in which the lubricant is used. The amounts should be sufficient to provide the desired effect, but not so great as to cause instability of the lubricant composition or other undesirable effects or add unnecessarily to the cost of the composition. To the extent the additives affect the viscosity of the composition, that should be taken into account. The suitable viscosity will depend on many factors such as the manner of application, the type of containers being lubricated and the speed of the conveyor operation. Typical lubricant formulations will have viscosities ranging up to 10,000 Centistokes.

The compositions of the present invention are typically prepared as dilutable liquid concentrates containing from 0.05 percent by weight to about 50 percent by weight, preferably 1 to 2 percent by weight of siloxane oil lubricant and about 0.05 to 20 percent by weight, preferably 1 to 6 percent by weight spreading agent. The dilutable compositions can be used without further dilution or may be diluted significantly with water prior to or when applied to the conveyor.

When used without dilution, the lubricants can provide thin, substantially non-dripping lubricating films. In this form, the lubricants provide substantially "dry" lubrication of the conveyors and containers, a cleaner and drier conveyor line due to less splashing than conventional aqueous lubricants and provide reduced lubricant usage, thereby reducing waste, cleanup and disposal problems. The dilutable liquid concentrates may also be diluted with significant amounts of water in the ratio of 1 part lubricant concentrate to from about 150 to about 1000 parts water, preferably from 350 to 500 parts water, before application to the conveyor. If water is employed in the lubricant compositions, preferably it is deionized water. Other suitable hydrophilic diluents include alcohols such as isopropyl alcohol.

The lubricant compositions of the present invention should be formulated so they do not include components in amounts which can adversely affect the conveyor track or the containers which are carried by the conveyor. For example, materials which induce stress cracking should be eliminated or minimized if the lubricants are to be used with PET bottles. Also, materials which bleach inks used for labeling should be minimized or eliminated.

Compositions of the present invention have the advantage that they spread more efficiently and completely on polymeric conveyor surfaces than previously known conveyor lubricant compositions containing polydimethylsiloxane. The compositions of the present invention do not bead up on and readily wet lubricant coated surfaces which are very hydrophobic. When the lubricant is applied to a polymeric conveyor surface, the conveyor surface soon becomes very hydrophobic due to the adsorption and/or absorption of the silicone oil lubricant on the surface. The lubricant persists on the surface so that it presents a very hydrophobic surface to subsequently applied lubricant. The lubricants of the present invention readily wet the oil soaked silicone lubricant surface as evidenced by the lubricants rapidly spreading on the surface without beading. The spreading agents useful in the present invention can evidence rapid spreading of the lubricant compositions on such surfaces with a spreading ratio of at least about 4 compared to water and preferably about 7. Some spreading agents provide spreading rations of more than 120 and even more than 150. The spreading ratio is defined for purposes of this invention as the linear spreading of the lubricant on a siloxane oil soaked polymeric surface at a given time after application compared to (divided by) the linear spreading of a similar volume of water on the same surface over the same time interval.

A useful test to determine the spreading ratios of the lubricants of the present invention is to compare spreading on a standard polybutene surface in a Petri dish. In this test, a drop of 50μ of the composition to be measured is applied to a polybutene surface in a Petri dish and after 30 seconds the linear movement of the liquid is measured by taking the average diameter of the substantially circular liquid. Pure water has been measured to have a diameter of about 10 mm. Water containing 0.1% by weight of the preferred spreading agent shown in the structural formula above, Silwet® L-7608, is applied under the same conditions and the movement of the drop is measured at 110 mm, a ratio of more than 10:1. Similarly, a fully formulated lubricant according to the examples shown below exhibits a spreading ratio of about 7.

Prior to application to the conveyor or container, the lubricant composition should be mixed sufficiently so that the lubricant composition is not substantially phase-separated. Mixing can be carried out using a variety of devices. For example, the lubricant composition or its individual components can be added or metered into a mixing vessel equipped with a suitable stirrer. The stirred lubricant composition can then be pumped to the conveyor or containers (or to both conveyors and containers) using a suitable piping system. If the container surface is coated with lubricant, it is only necessary to coat the surfaces that come into contact with the conveyor, and/or that come into contact with other containers. Similarly, only portions of the conveyor that contacts the containers need to be treated. The lubricant can be a permanent coating that remains on the containers throughout its useful life, or a semi-permanent coating that is removed from and not present on the container after it has completed the conveyor path.

Application of the lubricant composition can be carried out using any suitable technique including spraying, wiping, brushing, drip coating, roll coating, and other methods for application of a thin film. If desired, the lubricant composition can be applied using spray equipment designed for the application of conventional aqueous conveyor lubricants, modified as need be to suit the substantially lower application rates and preferred non-dripping coating characteristics of the lubricant compositions used in the invention. For example, the spray nozzles of a conventional beverage container lube line can be replaced with smaller spray nozzles or with brushes, or the metering pump can be altered to reduce the metering rate.

The lubricant can be applied to a conveyor system surface that comes into contact with containers, any container surface that needs lubricity (bottoms and/or sides), or both. The surface of the conveyor that supports the containers may typically comprise metal, plastic, elastomer, composites, or mixture of these materials. Any type of conveyor system used in the container field can be treated according to the present invention though the materials of the present invention are particularly effective with polymeric conveyor materials. Typical conveyor tracks used in the soft drink bottling industry for which the lubricants of the present invention are particularly preferred are tracks comprising polymeric links, for example polyethylene, polypropylene or polyacetal links. These are particularly useful with the PET bottles used in the soft drink industry. The conveyors for the high-speed bottling lines used in this industry may run at as much as 25 feet per minute to more than 100 feet per minute. The bottles must remain upright on these tracks as any tipping of the bottles can require shutdown of the line and reduced production.

Containers for which the lubricants are useful include beverage containers; food containers; household or commercial cleaning product containers; and containers for oils, antifreeze or other industrial fluids. The containers can be made of a wide variety of materials including glasses; plastics (e.g., polyolefins such as polyethylene and polypropylene; polystyrenes; polyesters such as PET and polyethylene naphthalate (PEN); polyamides, polycarbonates; and mixtures or copolymers thereof); metals (e.g., aluminum, tin or steel); papers (e.g., untreated, treated, waxed or other coated papers); ceramics; and laminates or composites of two or more of these materials (e.g., laminates of PET, PEN or mixtures thereof with another plastic material). The lubricants of the present invention are particularly effective with plastic and wax coated paper containers. The containers can have a variety of sizes and forms, including cartons (e.g., waxed cartons or TETRAPACK™ boxes), cans, bottles and the like. Although any desired portion of the container can be coated with the lubricant composition, the lubricant composition preferably is applied only to parts of the container that will come into contact with the conveyor or with other containers. Preferably, the lubricant composition is not applied to portions of thermoplastic containers that are prone to stress cracking. In a preferred embodiment of the invention, the lubricant composition is applied to the crystalline foot portion of a blow-molded, footed PET container (or to one or more portions of a conveyor that will contact such foot portion) without applying significant quantities of lubricant composition to the amorphous center base portion of the container. Also, the lubricant composition preferably is not applied to portions of a container that might later be gripped by a user holding the container, or, if so applied, is preferably removed from such portion prior to shipment and sale of the container. For some such applications the lubricant composition preferably is applied to the conveyor rather than to the container, in order to limit the extent to which the container might later become slippery in actual use.

These polymer materials can be used for making virtually any container that can be thermoformed, blow molded or shaped in conventional thermoplastic shaping operations. Included in the description of containers of the invention are containers for carbonated beverages such as colas, fruit flavored drinks, root beers, ginger ales, carbonated water, etc. Also included are containers for malt beverages such as beers, ales, porters, stouts, etc. Additionally, containers for dairy products such as whole, 2% or skim milk are included along with containers for juices, Koolaid® (and other reconstituted drinks), tea, Gatoraid® or other sport drinks, neutraceutical drinks and still (non-carbonated) water. Further, food containers for flowable but viscous or non-Newtonian foods such as catsup, mustard, mayonnaise, applesauce, yogurt, syrups, honey, etc. are within the scope of the invention. The containers of the invention can be virtually any size including (e.g.) five gallon water bottles, one gallon milk containers, two liter carbonated beverage containers, twenty ounce water bottles, pint or one half pint yogurt containers and others. Such beverage containers can be of various designs. Designs can be entirely utilitarian with a shape useful simply for filling transportation, sales and delivery. Alternatively, the beverage containers can be shaped arbitrarily with designs adapted for marketing of the beverage including the well known "coke" shape, any other decorative, trademarked, distinctive, or other design can be incorporated into the bottle exterior.

EXAMPLES

Example 1

Lubricant compositions according to the present invention were prepared as shown by formulas A and B and compared to a commercially available track lubricant having the formula C. All parts are shown as parts by weight unless otherwise indicated.

| | A | B | C |
|---|---|---|---|
| Trisiloxane ethoxylate (Silwet L-7608) | 5.0 | 1.0 | — |
| Polydimethyl siloxane lubricating oil emulsion (35%) | 5.0 | 5.0 | 5.0 |
| Isothiazoline biocide | 4.6 | 4.6 | 4.6 |
| Copper Sulfate | — | — | 0.03 |
| Citric Acid | — | — | 0.018 |
| Dipropyleneglycolmonomethylether | 4.0 | 4.0 | 4.0 |
| Deionized water | 81.4 | 85.4 | 86.35 |

The compositions prepared above were diluted at a ratio of 1 part lubricant to 200 parts water. Each material was sprayed on a section of acetal conveyor track to thoroughly wet the track. Then more lubricant of the matching type was applied to the track and the behavior observed. The formulas identified as A and B showed good wetting with no beading on the surface. When conventional lubricant formula C without the trisiloxane spreading agent was applied to the track, it beaded and puddled substantially/

Example 2

A lubricant composition of the invention is prepared by mixing the following ingredients in water. All parts are shown as parts by weight unless otherwise indicated.

| | |
|---|---|
| Trisiloxane ethoxylate (Silwet L-7608) | 4.8 pts/wt |
| Polydimethyl siloxane lubricating emulsion (35%) | 3.85 pts/wt |
| methyl-4-isothiazolin-3-one | 0.5 pts/wt |
| Deionized water | 90.85 pts/wt |

The compositions prepared above were diluted at a ratio of 1 part lubricant to 200 parts water. The material was sprayed on a section of acetal conveyor track and showed no beading on the surface. The spreading ratio of the lubricant was measured using the test as described above. The lubricant composition was diluted at the ratio of 1:200 and a single 50 ul drop was placed on a sheet of polybutene in a Petri dish. The spreading of the lubricant after 30 seconds averaged 47 mm in diameter versus water which spread to 6 mm.

The composition shown above was applied to polymeric conveyor track in a bottling facility by diluting the above composition in the ratio of 1 part lubricant concentrate to 200 parts by weight of water and sprayed continuously on the moving track sufficient to keep the track wet. PET bottles on the track were conveyed through a commercial high-speed bottling line at a rate of more than 25 feet per minute without falling and blocking the line thereby evidencing a satisfactory lubricant.

In addition when PET bottles were tested for environmental stress cracking using the lubricant of this example by an industry standard stress crack test, the lubricant passed the test indicating satisfactory stress crack performance.

Example 3

A lubricant composition is prepared by mixing the following ingredients in water. All parts are shown as parts by weight unless otherwise indicated.

| | |
|---|---|
| Trisiloxane ethoxylate (Silwet L-7608) | 3.5 pts/wt |
| Polydimethylsiloxane lubricating oil emulsion (35%) | 3.75 pts/wt |
| Silicone surfactant stabilizer (Silwet L-7002) | 2.0 pts/wt |
| Sodiumbenzisothiazoline (19% solution) | 0.5 pts/wt |
| Sodium cumene sulfate | 20.0 pts/wt |
| Phosphonate chelating agent | 0.07 pts/wt |
| Deionized water | 70.18 pts/wt |

The compositions prepared above were diluted at a ratio of 1 part lubricant to 200 parts water. The material was sprayed on a section of acetal conveyor track and showed no beading on the surface. The spreading ratio of the lubricant was measured using the test as described above. The lubricant composition was diluted at the ratio of 1:200 and a single 50 μ drop was placed on a sheet of polybutene in a Petri dish. The spreading of the lubricant after 30 seconds averaged 24 mm in diameter versus water which spread to 6 mm.

The composition shown above was applied to polymeric conveyor track in a bottling facility by diluting the above composition in the ratio of 1 part lubricant concentrate to 200 parts by weight of water and sprayed continuously on the moving track sufficient to keep the track wet. PET bottles on the track were conveyed through a commercial high-speed bottling line at a rate of more than 25 feet per minute without falling and blocking the line thereby evidencing a satisfactory lubricant.

In addition when PET bottles were tested for environmental stress cracking using the lubricant of this example by an industry standard stress crack test, the lubricant passed the test indicating satisfactory stress crack performance.

What is claimed is:

1. A method of lubricating a conveyor track or container comprising applying a composition comprising a silicone lubricating oil and a spreading agent, said composition having a spreading ratio of at least 4 on polybutene compared to water;

wherein said spreading agent is of the formula (II):

(II)

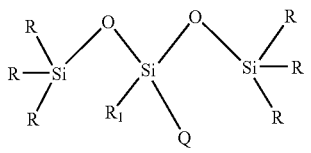

wherein Q is $C_dH_{2d}O[(C_2H_4O)_t(C_3H_6O)_w)]R_2$, d is 1-5, t is 0-25, w is 0-25, t+w=1-50; $R_2$ is hydrogen, hydroxyl, $C_1$ to $C_4$ alkyl, amine, or acetyl;

wherein each R is independently Q, hydrogen, hydroxyl, or $C_1$ to $C_4$ alkyl; and wherein $R_1$ is $C_1$ to $C_3$ alkyl.

2. The method of claim 1, wherein said spreading agent is a trisiloxane alkoxylate.

3. The method of claim 1, wherein said spreading agent is an alkyleneoxide modified heptamethyl trisiloxane.

4. The method of claim 1, wherein d is 2 or 3, t is 0-10, w is 0-10, t+w=1-10; $R_2$ is hydrogen or $C_1$ to $C_4$ alkyl; and each R is independently hydrogen or $C_1$ to $C_4$ alkyl.

5. The method of claim 4 wherein t is 3 or 4, w is 0; $R_2$ is hydrogen or methyl; every R is methyl; and $R_1$ is methyl.

6. The method of claim 1, wherein said silicone lubricating oil is water-miscible or water dispersible.

7. The method of claim 6 wherein said silicone lubricating oil is polydimethylsiloxane oil.

8. The method of claim 7 wherein said composition comprises 1 part by weight of said polydimethylsiloxane oil, and from 0.05 to 100 parts by weight of said spreading agent, and optionally, from 0 to 96 parts by weight water.

9. The method of claim 6 wherein the composition additionally comprises an effective amount of a biocide.

10. The method of claim 9 wherein said biocide comprises a methylated isothiazolone compound.

11. The method of claim 6 wherein the composition additionally comprises sodium cumene sulfate in an amount effective to improve environmental stress crack resistance to poly(ethyleneterephthalate) beverage containers.

12. The method of claim 6 wherein said silicone oil comprises 0.0005 to 50% by weight of the total composition.

13. The method of claim 12 wherein said silicone oil comprises 0.0005 to 0.2% by weight of the total composition.

14. The method of claim 6 wherein said composition comprises 0.0005 to 50% by weight of said spreading agent.

15. The method of claim 12 wherein said composition comprises 0.0005 to 0.2% by weight of said spreading agent.

16. The method of claim 5 wherein said composition comprises the following:

| | |
|---|---|
| Trisiloxane ethoxylate | 4.5 to 5.5 pts/wt |
| Polydimethyl siloxane lubricating emulsion | 1.0 to 1.5 pts/wt |
| methyl-4-isothiazolin-3-one | 0.2 to 0.8 pts/wt |
| Deionized water | 94.3 to 92.2 pts/wt. |

17. The method of claim 5 wherein said composition comprises the following:

| | |
|---|---|
| Trisiloxane ethoxylate | 3 to 4 pts/wt |
| Polydimethylsiloxane lubricating oil emulsion | 1 to 1.5 pts/wt |
| Silicone surfactant stabilizer | 1.5 to 2.5 pts/wt |
| 1,2 benzisothiazolin-3-one | 0.2 to 0.8 pts/wt |
| Sodium cumene sulfate | 15 to 25 pts/wt |

-continued

| | |
|---|---|
| Phosphonate chelating agent | 0.05 to 0.1 pts/wt |
| Deionized water | 79.25 to 66.1 pts/wt. |

18. A method of lubricating a conveyor track or container comprising applying a composition comprising a silicone lubricating oil and a spreading agent, said composition having a spreading ratio of at least 4 on polybutene compared to water, wherein said silicone oil is 0.0005 to 0.2% by weight of the total composition, wherein said silicone lubricating oil is polydimethylsiloxane oil, and said spreading agent is of the formula (II):

(II)

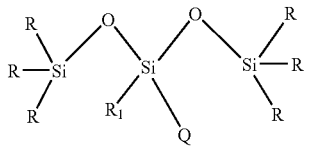

wherein Q is $C_dH_{2d}O[(C_2H_4O)_t(C_3H_6O)_w)]R_2$, d is 1-5, t is 0-25, w is 0-25, t+w=1-50; $R_2$ is hydrogen, hydroxyl, $C_1$ to $C_4$ alkyl, amine, or acetyl;

wherein each R is independently Q, hydrogen, hydroxyl, or $C_1$ to $C_4$ alkyl; and wherein $R_1$ is $C_1$ to $C_3$ alkyl.

19. A method of lubricating a conveyor track or container comprising applying a composition comprising a silicone lubricating oil and a spreading agent, said composition having a spreading ratio of at least 4 on polybutene compared to water, wherein said spreading agent is 0.0005 to 0.2% by weight of the total composition, wherein said silicone lubricating oil is polydimethylsiloxane oil, and said spreading agent is of the formula (II):

(II)

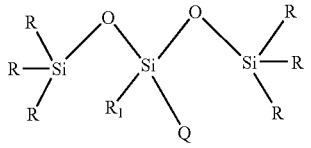

wherein Q is $C_dH_{2d}O[(C_2H_4O)_t(C_3H_6O)_w)]R_2$, d is 1-5, t is 0-25, w is 0-25, t+w=1-50; $R_2$ is hydrogen, hydroxyl, $C_1$ to $C_4$ alkyl, amine, or acetyl;

wherein each R is independently Q, hydrogen, hydroxyl, or $C_1$ to $C_4$ alkyl; and wherein $R_1$ is $C_1$ to $C_3$ alkyl.

* * * * *

UNITED STATES PATENT AND TRADEMARK OFFICE

CERTIFICATE OF CORRECTION

PATENT NO. : 7,592,296 B2
APPLICATION NO. : 11/195164
DATED : September 22, 2009
INVENTOR(S) : Barry D. Sperling It is certified that error appears in the above-identified patent and that said Letters Patent is hereby corrected as shown below:

Title Page

Add

Related U.S. Application Data

(60) Provisional application No. 60/522,025, filed on Aug. 3, 2004

Signed and Sealed this

Twenty-sixth Day of January, 2010

David J. Kappos

David J. Kappos
*Director of the United States Patent and Trademark Office*